US008784222B2

(12) United States Patent
Nelson

(10) Patent No.: US 8,784,222 B2
(45) Date of Patent: Jul. 22, 2014

(54) TRACK CONFIGURED FOR PASSING THROUGH TURNS

(75) Inventor: Gary A. Nelson, Concord, NC (US)

(73) Assignee: Gary Nelson & Associates, Inc., Concord, NC (US)

( * ) Notice: Subject to any disclaimer, the term of this patent is extended or adjusted under 35 U.S.C. 154(b) by 142 days.

(21) Appl. No.: 13/325,281

(22) Filed: Dec. 14, 2011

(65) Prior Publication Data

US 2013/0157769 A1 Jun. 20, 2013

(51) Int. Cl.
*A63K 1/00* (2006.01)
*A63C 19/10* (2006.01)

(52) U.S. Cl.
USPC ..... 472/85; 472/89; 404/17

(58) Field of Classification Search
USPC ..... 472/85–89; 404/1, 17, 19
See application file for complete search history.

(56) References Cited

U.S. PATENT DOCUMENTS 877,993 A * 2/1908 Georges ..... 472/86
1,848,496 A * 3/1932 Schutte ..... 404/19
3,445,063 A * 5/1969 Ferentinos ..... 238/10 R
3,810,706 A * 5/1974 Grimm et al. ..... 404/1
5,800,272 A * 9/1998 Pons ..... 472/85
6,364,419 B1 4/2002 Cannizzo et al.
6,402,252 B1 6/2002 Dickson
7,121,761 B2 * 10/2006 Woodruff ..... 404/17
7,651,293 B2 1/2010 Shaw et al.

FOREIGN PATENT DOCUMENTS

EP 1136252 7/2005

* cited by examiner

*Primary Examiner* — Kien Nguyen
(74) *Attorney, Agent, or Firm* — Thomas D. McClure, Jr.

(57) ABSTRACT

The present invention provides a race track configured to encourage passing. The race track includes a pavement that defines a turn, a first path around the turn, and a second path around the turn. The second path is longer than the first path, and the two paths are spaced-apart such that a first car can travel on the first path and a second car can travel on the second path in an overlapped position relative to the first car. At least a portion of the first path passing over a plurality of depressions defined in the pavement at predetermined positions. The depressions configured to reduce the amount of friction available to the first car such that the first car is slowed sufficiently for the second car to maintain the overlap position or pass the first car through the turn as the second car travels on the longer second path.

19 Claims, 9 Drawing Sheets

TRACK CONFIGURED FOR PASSING THROUGH TURNS

FIELD OF THE INVENTION

The invention relates generally to pavement configured to control relative vehicle speed and specifically to pavement in race track turns that is configured to promote passing.

BACKGROUND OF THE INVENTION

Automotive racing is a competitive sport that has many fans and can be conducted between a variety of wheeled vehicles such as open-wheeled cars, closed-wheeled cars, and trucks (all of which are referred to herein by the term "cars"). However, a problem with current racing is the apparent perception by at least some fans that it can lack excitement. Another problem is that the outcome of a given race might be determined by racing strategy such that a slower car can win a race against a faster car. These two problems are related because passing during a race is a mechanism that allows for a faster car to demonstrate its superiority and passing can make for exciting racing. Yet on some race tracks, it is very difficult for a trailing car to pass a leading car even if the trailing car is faster.

Generally, three conditions must be met when a trailing car successfully passes a leading car. First, the trailing car must be capable of travelling faster than the leading car. Second, the trailing car must be able to gain an overlapped position, i.e., an at least partially side-by-side position, such that the leading car cannot block forward progress of the trailing car. Third, the first and second conditions must exist for a sufficient time such that the trailing car can get around the leading car and assume its position.

As stated above, when passing it is necessary for two cars to be side-by-side at some time as the pass is occurring. However, in current automotive racing, constraints in vehicle design and track configuration don't always allow cars to be side-by-side through a turn. As a result, passing cannot take place through a turn. If a portion of a track includes a sufficiently long straightaway, then it is possible that all three conditions for a successful pass can be met during a lap. However, if there is no such straightaway, then a faster car might be unable to pass a slower car because the faster car must drop behind the slower car as the cars enter a turn.

Therefore, one problem with automotive racing on conventional tracks is that it can be difficult or impossible for a trailing car, even if faster, to maintain an overlapped position on a leading car through a turn. One conventional solution to this problem is for the track to be banked more toward the outside of a turn than toward the inside of a turn. This solution is often not satisfactory because it can be very difficult to form a track with varying degrees of banking and cars have trouble moving between areas of different banking.

Another problem with automotive racing on conventional tracks is that when two or more cars pass through a turn together, an inside car travels a shorter total distance than an outside car. Therefore the outside car must be at least able to travel sufficiently faster than the inside car such that the outside care can maintain the outside position when entering the next straight-away. If the outside position can be maintained into the next straight away, then the pass can be continued into the next straightaway and possibly completed before the next turn begins.

The present invention addresses these problems by providing a track configured such that when a slower vehicle is ahead of a faster car going into a turn, the faster car has the opportunity to at least maintain its position relative to the slower vehicle.

SUMMARY OF THE INVENTION

The present invention addresses the foregoing problems by providing a racetrack that includes a turn configured such that a trailing car can maintain overlap on a leading car through a turn. More specifically, the present invention provides a track that reduces the amount of centripetal force available to a leading car that is overlapped during a turn such that a pass of the leading car can be maintained through the turn.

In accordance with one embodiment of the present invention, there is provided a race track configured to encourage passing. The race track includes a pavement that defines a turn, a first path around the turn, and a second path around the turn. The second path is longer than the first path. The first path and the second path are spaced-apart such that a first car can travel on the first path and a second car can travel on the second path in an overlapped position relative to the first car. At least a portion of the first path is positioned over a plurality of depressions defined in the pavement at predetermined positions. The depressions are configured to reduce the amount of friction available to the first car such that the first car is slowed sufficiently for the second car to maintain the overlap position or pass the first car through the turn as the second car travels on the longer second path.

In accordance with one aspect of the present invention, the depressions are in the form of grooves.

In accordance with another aspect of the present invention, the depressions are in the form of grooves the grooves extend radially from an inside of the turn to an outside of the turn.

In accordance with another aspect of the present invention, the grooves are evenly spaced-apart.

In accordance with another aspect of the present invention, the grooves are positioned to define a crosshatched pattern.

In accordance with another aspect of the present invention, the depressions are in the form of pits.

In accordance with another aspect of the present invention, the depressions are positioned such that they are contacted only by tires on one side of the first car.

In accordance with another embodiment of the present invention, there is provided a race track configured to define at least two lanes. The track includes a pavement that has a bearing surface configured to support a vehicle. The pavement is configured to define a first lane on the bearing surface along at least a portion of the circumference of the track. The pavement is configured to define a second lane on the bearing surface along at least a portion of the circumference of the track. A first area of the bearing surface is available to contact a tire-patch of predetermined size in the first lane. A second area of the bearing surface is available to contact the tire-patch of predetermined size in the second lane, the second area is larger than the first area.

In accordance with another aspect of the present invention, the track includes a turn and the first lane and the second lane are defined within the turn.

In accordance with another aspect of the present invention, the track includes an inside and an outside.

In accordance with another aspect of the present invention, the first lane and the second lane begin at a first imaginary line that extends from the infield to the outside edge of the track and first lane and the second lane end at a second imaginary line that extends from the infield to the outside edge of the track such that the second lane is longer than the first lane.

In accordance with another aspect of the present invention, the pavement of the first path defines depressions formed therein that extend away from the surface into the pavement.

In accordance with another embodiment of the present invention, a turn in a race track is configured such that passing within the turn is encouraged. The turn includes a beginning of the turn, an ending of the turn, and a pavement. A first path passes through the turn from the beginning of the turn to the end of the turn and the first path has a first length. A second path that passes through the turn from the beginning of the turn to the end of the turn and the second path has a second length that is longer than the first length. The pavement has a surface configured to contact tires of vehicles in the turn. The surface is configured to define the first path and to define the second path such that a sufficient centripetal force is available to a car in the second path such that a car in the second path can maintain an overlap position on the car in the first path.

In accordance with another aspect of the present invention, each tire of the first car and each tire of the second car can contact the surface in a maximum area defined by a contact patch and a working area of each contact patch is the fraction of the contact patch that actually contacts the surface, the surface being configured such that the working area available to the first car as it travels in the first path is less than the working area available to the second car as it travels in the second path.

In accordance with another aspect of the present invention, the working area available to the first car is not evenly distributed between the tires.

In accordance with another aspect of the present invention, wherein the pavement of the first path defines depressions formed therein that extend away from the surface into the pavement.

In accordance with another aspect of the present invention, the depressions are in the form of grooves.

In accordance with another aspect of the present invention, the grooves extend radially from an inside of the turn to an outside of the turn.

In accordance with another aspect of the present invention, the depressions are in the form of pits.

DESCRIPTION OF THE DRAWINGS

For a fuller understanding of the nature and objects of the present invention, reference should be made to the following detailed description taken in connection with the accompanying drawings, wherein.

DETAILED DESCRIPTION OF THE PREFERRED EMBODIMENTS

Figure 1:
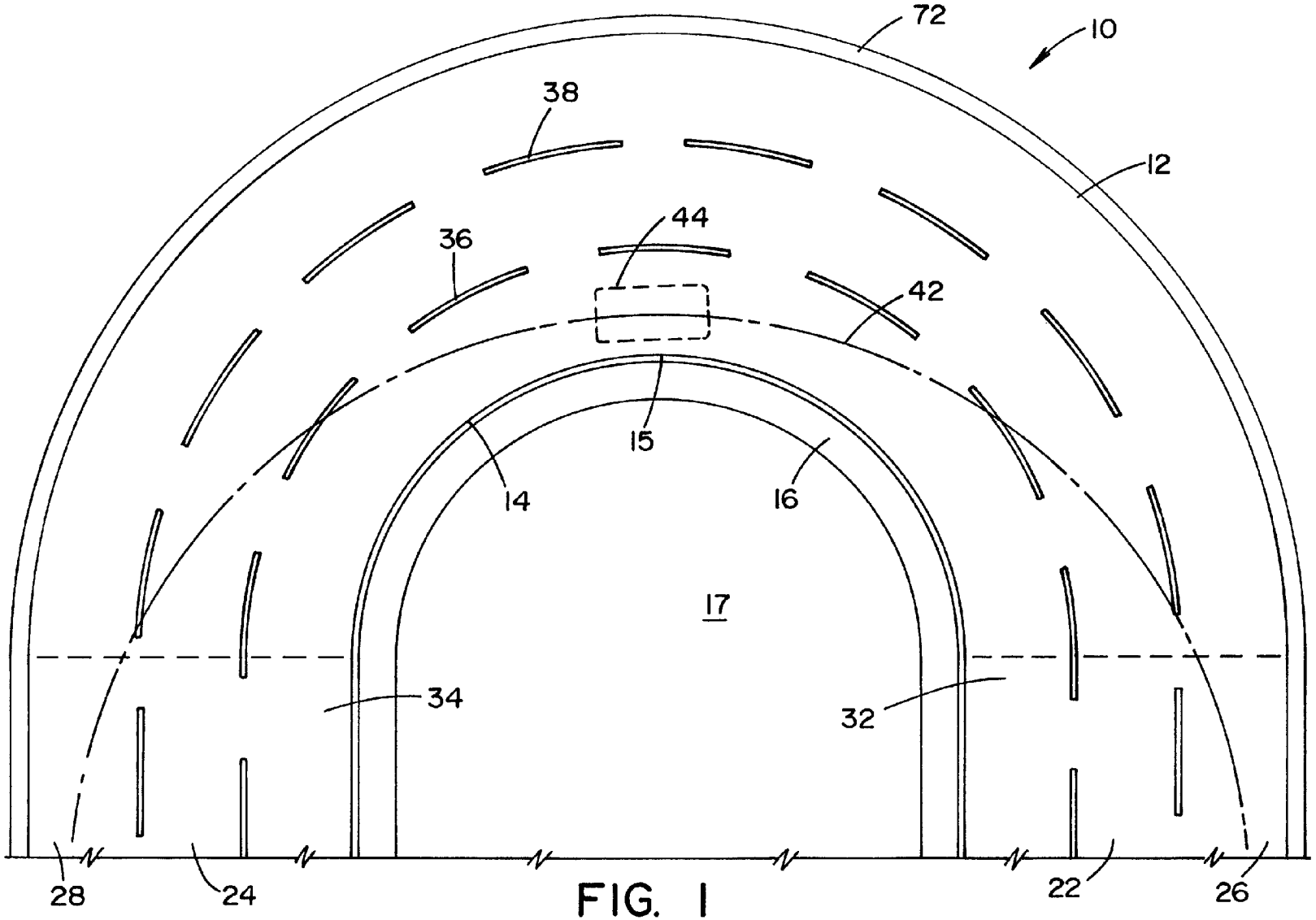
FIG. 1 is an overhead view of a portion of a race track showing a turn.

Embodiments of the present invention are directed to an improved race track surface configured to provide for side-by-side racing through turns so that opportunities for passing during a race are increased. Referring now to FIG. 1, there is shown a turn 10 of a race track. It should be appreciated that the race track can be configured as a loop on which the race is run in laps, as a point to point course, or as a combination thereof. Turn 10 is defined by an outside 12 and an inside 14. An apron 16 is positioned adjacent to inside 14 and apron 16 is a transition area between inside 14 of turn 10 and an infield 17.

As shown in FIG. 1, turn 10 provides a 180 degree change in direction from a front first straightaway 22 to a back second straightaway 24. As used herein, the term "turn" refers to any portion of the track where a change in direction must be made in order to stay on the track. The minimum number of degrees which a cars direction can change in a turn is just above zero and the maximum is 360 degrees. For example a circular track would have a single turn of 360 degrees. Turn 10 is defined as beginning at an imaginary start 26 where cars approaching turn 10 begin to change direction in order to make turn 10 and ending at an imaginary exit 28 where a change in course by a car is not determined by a need to negotiate turn 10.

In the embodiment shown in FIG. 1, there is a first transition zone 32. First transition zone 32 is defined as the area between start 26, which can be on the front straightaway 22, and the area where inside 14 and outside 12 begin to curve. There is also a second transition zone 34 which is defined between the area where inside 14 and outside 12 straighten and a point on back straightaway 24. As shown in FIG. 1, three lanes are defined by lane markers 36 and 38 that are generally evenly spaced-apart from inside 14, each other, and outside 12. An ideal line 42 indicates a path that a first car 44 follows when first car 44 is going around turn 10 alone at a maximum speed. Generally, ideal line 42 is an arc that has a radius such that ideal line 42 begins near outside 12 on the front straightaway 22 in the first transition zone 32, passes near inside 14 near apex 15, and ends near outside 12 on the rear straightaway 24 in the second transition zone 34. In this manner, first car 44 follows a path, indicated by ideal line 42 that has a radius approaching the maximum radius that can be accommodated through turn 10. For a given speed the car requires a lower centripetal force to navigate turn 10 as a result of traveling the path indicated by ideal line 42 as will be discussed below.

Figure 2:
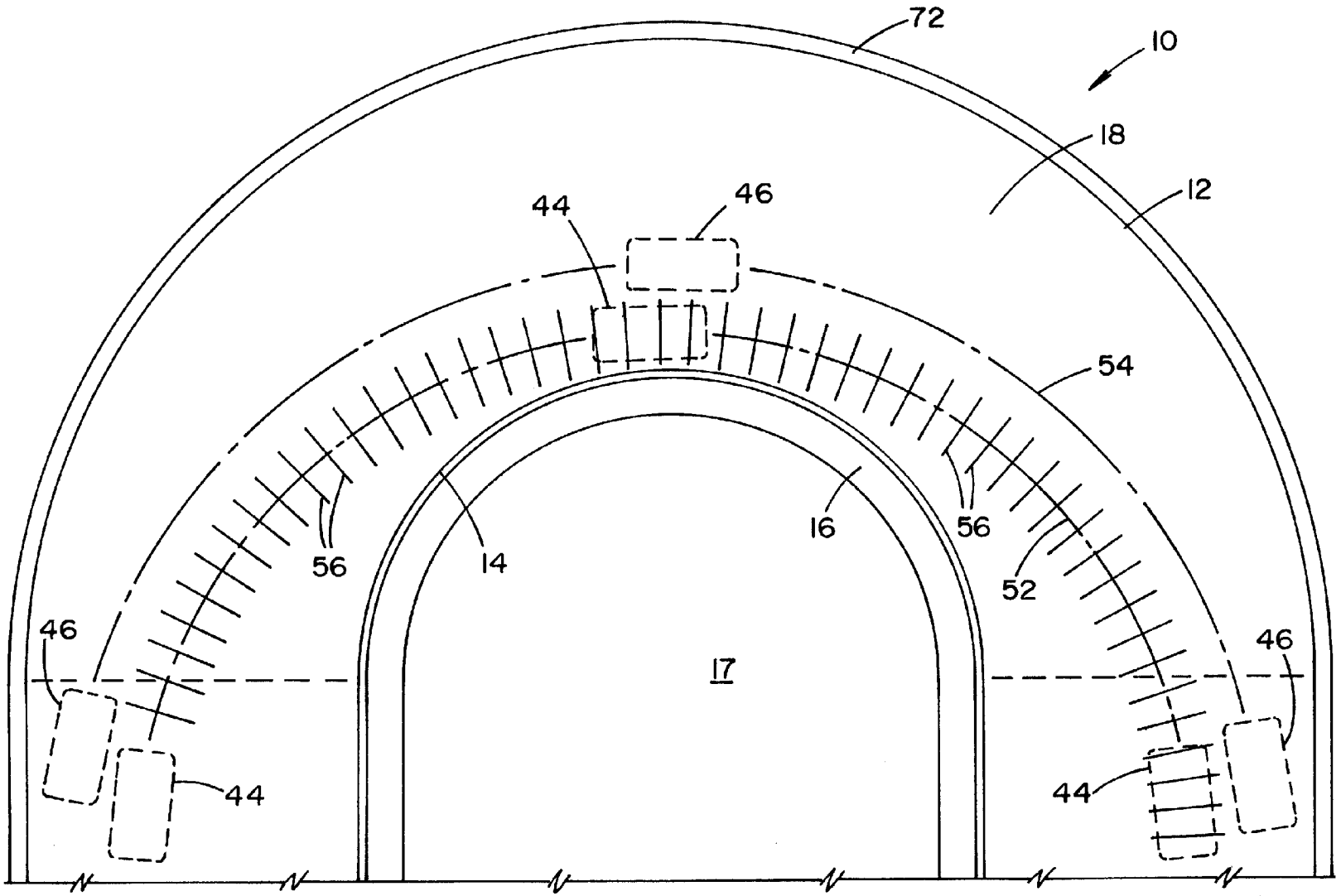
FIG. 2 is an overhead view of a portion of a race track showing a turn configured in accordance with one embodiment of the present invention with two cars in an overlapped position.

Referring now to FIG. 2, first car 44 is shown alongside a second car 46 that is positioned to the outside of, and overlapped with, first car 44 at different points around turn 10 showing that first car 44 and second car 46 remain overlapped. As used herein, the term "overlapped" refers to the relative position of a pair of cars in which a line extending away from the rear of one of the cars and perpendicular to a centerline of the car intersects with at least a portion of the other car. When second car 46 is overlapped on the outside of first car 44 as shown, second car 46 is not free to move closer to inside 14 and first car 44 is not free to move closer to outside 12. As a result, ideal line 42 is not an available route to either car as they pass through the transition zone and cross the imaginary start 26. Therefore, first car 44 travels an inside line 52, or inside path, and second car 46 travels an outside line 54, or outside path. Ideal line 52 is dimensioned to maximize the radius of the arc that first car 44 travels such that first car 44 avoids contact between first car 44 and second car 46 and first car 44 approaches a maximum speed possible while maintaining control of the car.

Outside line 54 is dimensioned to maximize the radius of the arc that second car 46 travels such that second car 46 avoids contact with first car 44 and second car 46 is able to maintain overlap relative to first car 44. It is believed that such lines of travel are the general result of drivers attempting to maximize speed by, in effect, minimizing the amount of centripetal force required to complete turn 10 while also minimizing the likelihood of damaging contact between the cars. This action by the drivers is the same action that defines the path indicated by ideal line 42. However when cars are overlapped as shown in FIG. 2, a driver does not have the option to utilize the entire area of pavement 18 available in turn 10 as one does when rounding a turn alone. A plurality of depressions in the form of grooves 56 are defined in pavement 18 along inside line 52.

Figure 3:
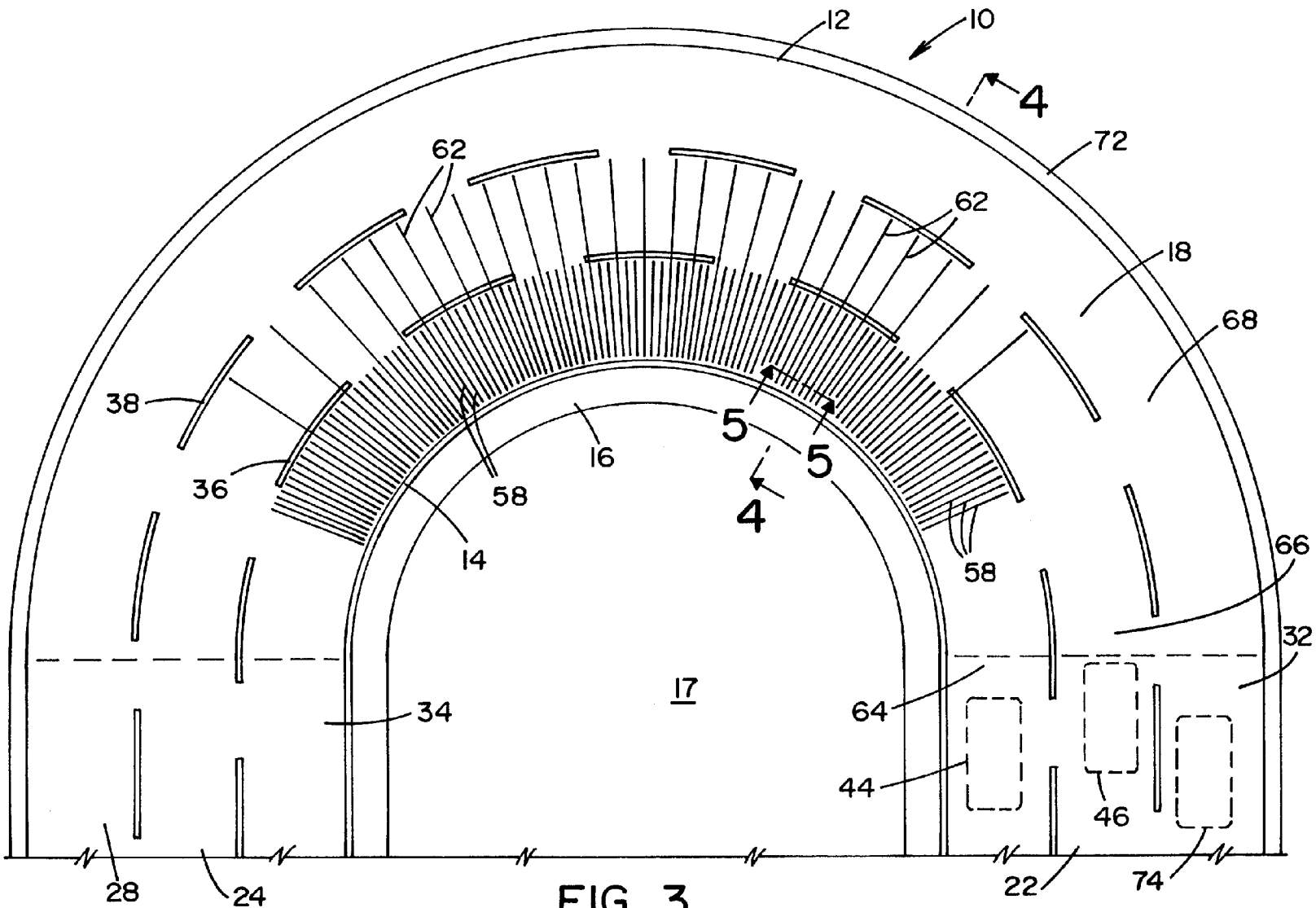
FIG. 3 is an overhead view of a portion of a race track showing a turn configured in accordance with another embodiment of present invention with three cars.

Referring now to FIG. 3, another embodiment of the present invention is shown. In this embodiment, a plurality of depressions in the form of inside grooves 58 are defined in pavement 18 in inside lane 64 along a portion of turn 10 and a plurality of grooves 62 are defined in pavement 18 in middle lane 66 along a portion of turn 10. The grooves in inside lane 64 are at a predetermined spacing. In contrast, the grooves in middle lane 66 are positioned at a predetermined spacing and varied spacing.

First car 44 is positioned in inside lane 64, second car 46 is positioned in middle lane 66 and a third car 74 is positioned in outside lane 68.

Figure 4:
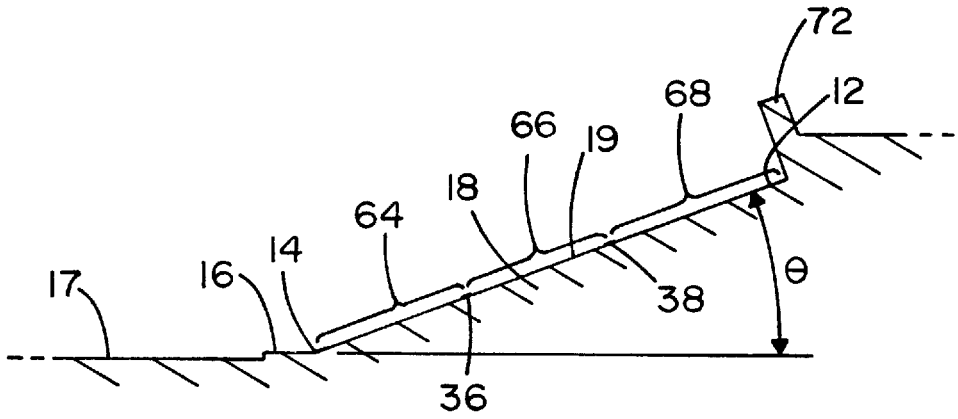
FIG. 4 is a cutaway side view of a portion of the track shown in FIG. 3 taken along line 4-4.

Referring now to FIG. 4, pavement 18 is configured such that the track is banked such that it passes around turn 10 at an angle $\Theta$ such that outside 12 is higher than inside 14. In a preferred embodiment, the angle $\Theta$ is between about 0 degrees and 45 degrees, more preferably the angle $\Theta$ is between about 3 degrees and about 30 degrees, even more preferably the angle $\Theta$ can be between 5 degrees and 12 degrees. An outside wall 72 is positioned along outside 12 of turn 10.

Figure 5:
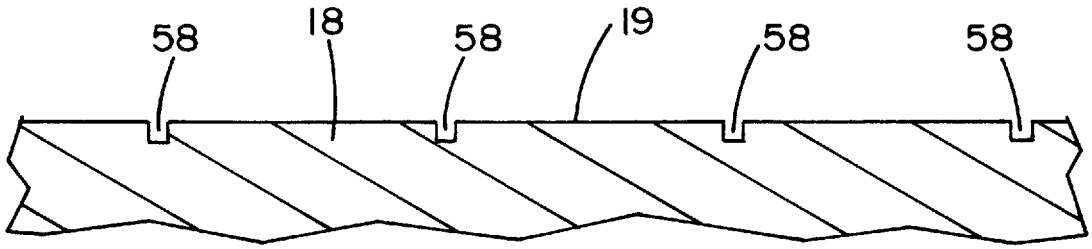
FIG. 5 is a cutaway view of a segment of the track shown in FIG. 3 taken along line 5-5.

Referring now to FIG. 5, inside grooves 58 are formed of slots cut in pavement 18 such that inside grooves 58 extend radially away from inside 14 toward outside 12. As shown in FIG. 5, inside grooves 58 are substantially evenly spaced-apart. As shown in FIG. 3, middle grooves 62 are not evenly spaced-apart. Spacing of grooves in pavement 18 according to the present invention is determined according to the desired operation thereof as will be discussed further below.

Figure 6:
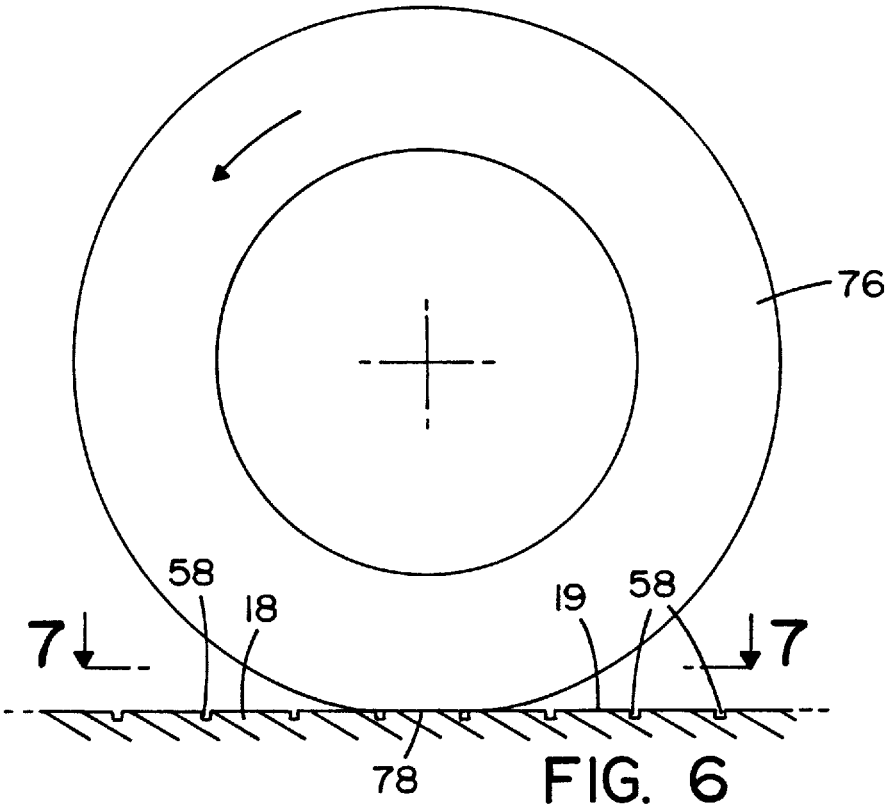
FIG. 6 is a schematic side view of a wheel engaging a track configured in accordance with the present invention.
Figure 7:
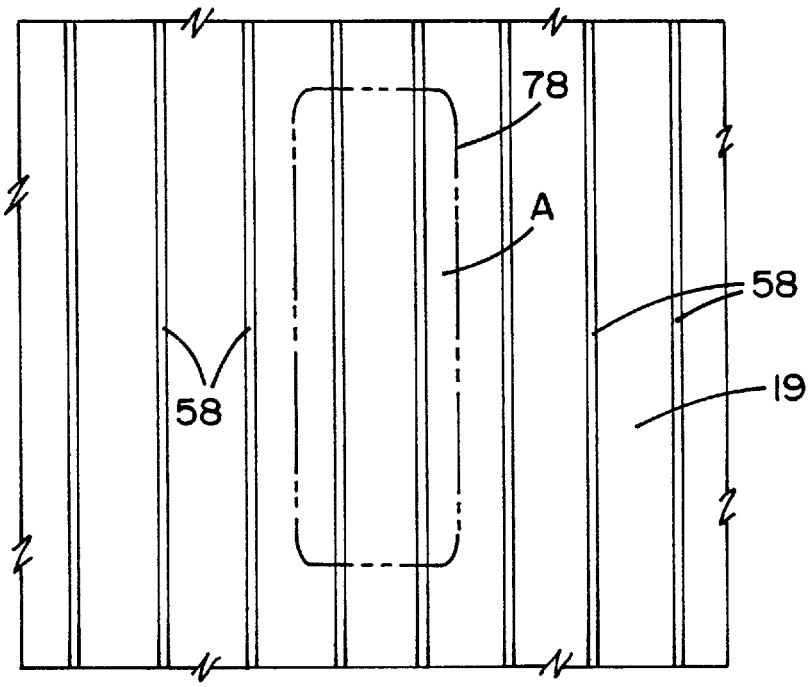
FIG. 7 is an overhead view of a contact patch defined by the wheel in FIG. 6 along line 7-7.

Referring now to FIGS. 6 and 7, pavement 18 defines a contact surface 19 that is configured to engage a tire 76. The area in which tire 76 contacts surface 19 defines a contact patch 78. The dimensions of contact patch 78 depend upon many factors such as, by way of example and not limitation, size and shape of tire 76, composition of tire 76, pressure within tire 76, down force toward surface 19 being applied through tire 76, and a combination thereof. As should be understood by one skilled in the art, variation of the size of contact patch 78 varies the amount of friction force that can be transmitted between tire 76 and surface 19. In many racing series, the characteristics of tire 76 that affect the size of contact patch 78 are determined by the rules of the series such that the tires used by all competitors are substantially the same.

A working area A is the portion of contact patch 78 in which tire 76 is engaged with surface 19. Working area A is determined by the uniformity of surface 19 and therefore is determined by the presence or absence of grooves 58 beneath contact patch 78. As shown in FIG. 7, two grooves 58 intersect contact patch 78 such that working area A is less than 100% of contact patch 78. The working area A thus is determined at least in part by the location of tire 76, and thus contact patch 78, on the track. For example if contact patch 78 is located in an area where there are no grooves such as outside lane 68 shown in FIG. 3, the working area A is generally equal to the total area of contact patch 78. Therefore the amount of frictional force that can be applied between tire 76 and surface 19 is maximized. If tire 76 is located over one or more grooves 58, the working area A is reduced according to the number of grooves that are covered by contact patch 78 and the configuration of those covered grooves.

Figure 8:
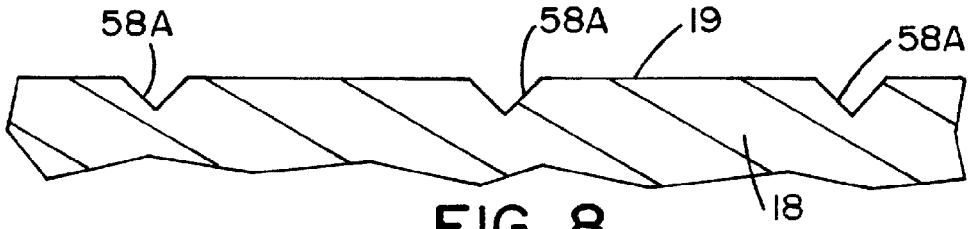
FIG. 8 is a view of the segment of the track shown in FIG. 5 according to another embodiment of the present invention.
Figure 9:
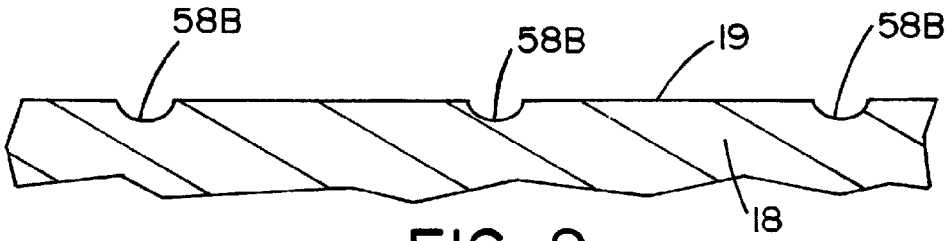
FIG. 9 is a view of the segment of the track shown in FIG. 5 according to another embodiment of the present invention.

Referring now to FIG. 8 and FIG. 9, the depressions can be configured in many different shapes. For example grooves 58 shown in FIG. 5 have a generally U-shaped cross section with sides that are generally parallel to each other and perpendicular to a bottom portion of grooves 58. Grooves 58A have a generally V-shaped cross section and grooves 58B have a semicircular cross section. It should be appreciated that in other embodiments the grooves can be of many different shapes, the edges can be chamfered, sloped, or curved. The cross section of a groove can be a simple geometric shape such as those shown in FIGS. 5, 8, and 9 or the cross sections can be more complex geometries.

Figure 10:
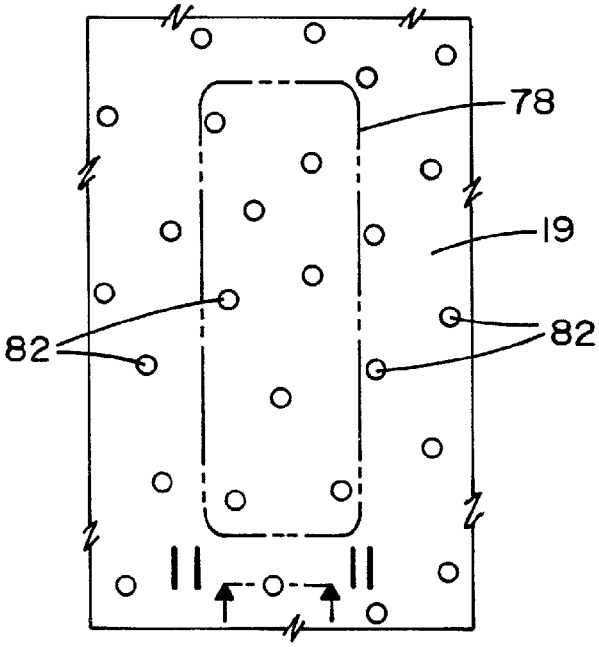
FIG. 10 is an overhead view similar to FIG. 7 of a contact patch defined by a wheel positioned over a track surface that is configured according to yet another embodiment of the present invention.
Figure 11:
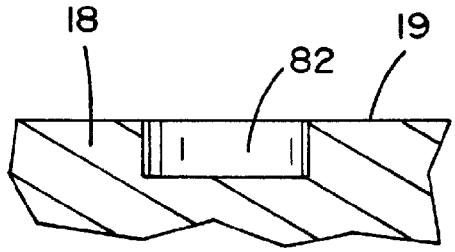
FIG. 11 is a cutaway side view of a portion of the track shown in FIG. 10 taken along line 11-11.

In an alternative embodiment shown in FIGS. 10 and 11, the working area A is reduced by pits or depressions such as a plurality of discrete pits 82. As discussed above regarding the grooves, the actual shape of pits 82 can vary from that shown in the illustrated embodiment.

Figure 12:
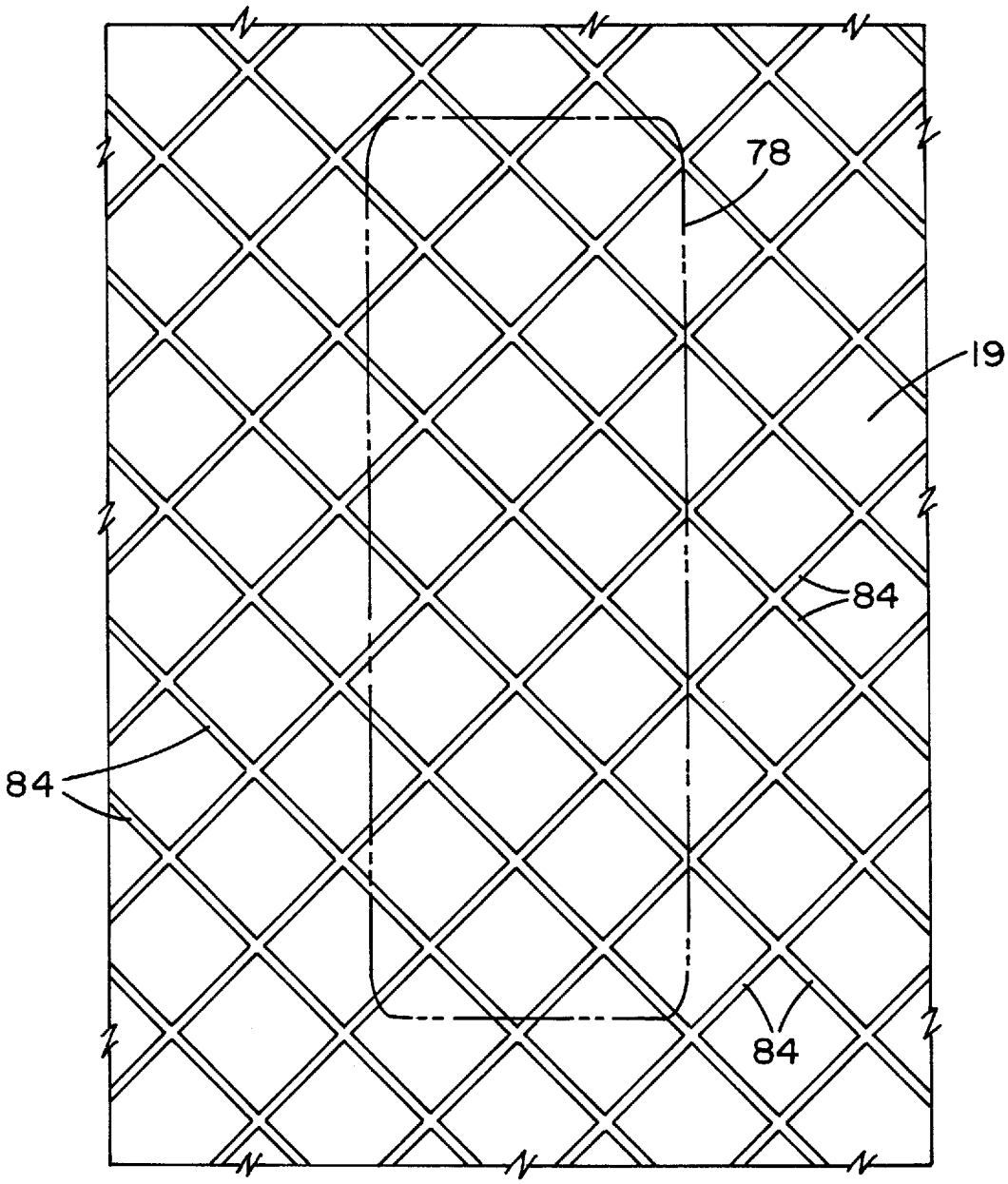
FIG. 12 is an overhead view similar to FIG. 7 of a contact patch defined by a wheel positioned over a track surface that is configured according to yet another embodiment of the present invention.

In another alternative embodiment, working area A can be reduced by connected grooves or pits or a combination thereof. As shown in FIG. 12, pavement 18 is crosshatched with a plurality of cross hatched grooves 84.

Figure 13:
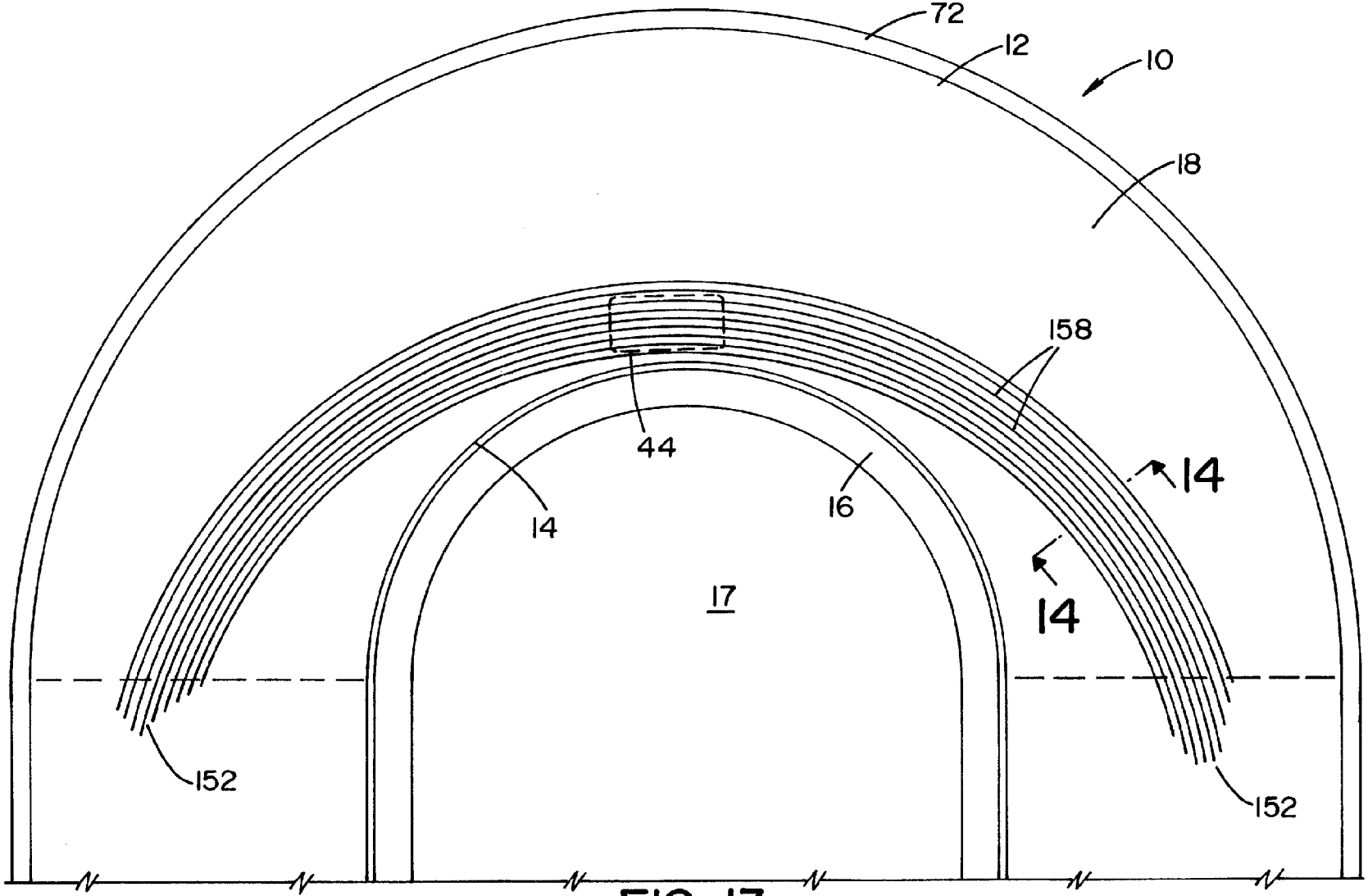
FIG. 13 is an overhead view of a portion of a race track showing a turn configured in accordance with an alternative embodiment of the present invention with two cars in an overlapped position.
Figure 14:
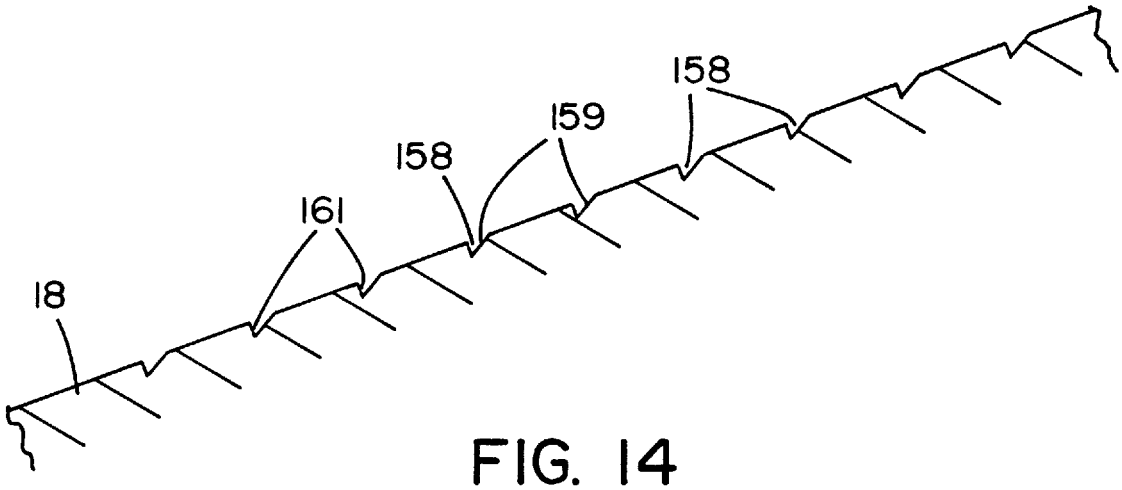
FIG. 14 is a cutaway side view of a portion of the track shown in FIG. 13 taken along line 14-14.

In another alternative embodiment, the grooves can be substantially parallel to the direction of travel of a car passing over the grooves. This embodiment is shown in FIG. 13, where grooves 158 are substantially concentric with a path 152 is substantially similar to inside line 52 as shown in FIG. 2. The cross section of grooves 158 shown in FIG. 14 shows that the profile of grooves can be configured such that effects caused by tires extending into grooves 158 can be minimized by sloping or rounding an outside wall 159 of grooves 158 away from an inside wall 161. In this manner, grooves 158 are configured such that a gripping effect caused by a tire extending into groove 158 is reduced. As shown in FIG. 13. grooves 158 can be positioned such that they begin at different positions around the turn. It should be appreciated that positioning of the grooves 158 and their respective lengths can be chosen to affect the speed of cars in a desired manner.

The present invention can be better understood by a description of the operation thereof with reference to first car 44 and second car 46 entering turn 10 as shown in FIG. 2. In this regard, grooves 56 are positioned in turn 10 such that when first car 44 enters turn 10 overlapped with second car 46, the fastest route available to first car 44 is over grooves 56. However, the speed of first car 44 is limited such that it is slower than if the grooves 56 were not present. As first car 44 travels over grooves 56 it's speed is limited by the amount of grip, or friction, available to the tires. As indicated above, this is a function of the working area A. Working area A is chosen so that first car 44 is able to safely navigate turn 10, but is unable to get ahead of, i.e., break overlap with, second car 46 before the two cars exit turn 10. In effect, the grooves cause first car 44 to travel more slowly through turn 10 than it otherwise would have. The reduced speed of first car 44 allows second car 46 to maintain its overlapped position through turn 10. As first car 44 and second car 46 exit turn 10, second car 46 is in position to complete the pass on the back straightaway 24.

In some situations, second car 46 might lose speed within turn 10 or otherwise be unable to maintain its overlapped position during turn 10. If this occurs, first car 44 would have the opportunity to position itself closer to ideal line 42, eventually move off of the grooves 56 and increase speed more than it otherwise would have before exiting turn 10. In another race scenario, second car 46 could have gained an overlapped position entering turn 10 because first car 44 slowed to avoid traffic or debris on the track. In this case, first car 44 might regain the lead during turn 10 as described above.

In an alternate embodiment, grooves 56 and 58 are positioned to encourage passing attempts that involve three cars through turn 10, as illustrated in FIG. 3.

It should be appreciated that the reduction in working area A can affect all four tires of a car as in the above-illustrated examples, or working area A could affect one, two, or three tires at a given time. This will be determined by the spacing of the configuration of the track as it relates to the spacing of the grooves, pits, grid, or combination thereof. It is believed that a driver will detect and compensate for reduced grip provided for by the present invention as long as it is uniform and predictable. In some situations a reduction in friction of only a fraction of a percent will be sufficient to slow a car on ideal line 52 enough for a car on outside line 54 to maintain overlap.

The present invention addresses passing of racing vehicles as they approach and pass through a turn. In many types of modern racing, such as stock car or open wheel racing, vehicles are limited by rules such that require competing cars to be very similar. These rules are promulgated by the sanctioning body of a given race or race series. In some cases racing vehicles have such similar capabilities that the difference of maximum speed of two cars is not sufficient for a trailing car to overcome advantages a leading car has even if the trailing car is faster. One area of a track in which a leading car has an advantage over trailing cars is in turns. Such an advantage results from the leading car having the ability to choose the fastest route through a turn. On conventional tracks, the fastest route through a turn is one with the largest possible radius. This is because the centripetal force required to make a turn is inversely proportional to the radius of turn 10. The centripetal force available to a car is generally provided by three components, the downforce of the car in combination with track banking, the coefficient of friction between the vehicle wheels and the track surface, and aerodynamic side loading.

In conventional racing all of these factors are limited by rules such that competing vehicles have essentially the same amount of centripetal force available. Therefore if the leading car follows an ideal line through a turn and is operating at the maximum speed possible on that line any vehicle that is in position to pass, i.e. following a different line through turn 10, will not be able to navigate turn 10 in the same time as the lead car because even if the trailing car had sufficient power to navigate turn 10 on a different path at a substantially equal or faster speed, there is not sufficient centripetal force available to the trailing car to navigate the second route at that speed.

In order to complete a turn, centripetal force must be applied to the car. In a high speed vehicle race, such as a stock car or open wheel car race, the centripetal force applied to a car for it to negotiate a turn can come from three sources. These sources are down force (which can be determined by the weight of the car, aerodynamic down forces, and the banking of the track), aerodynamic side forces, and frictional forces transmitted from the track surface through the tires to the passing car.

The centripetal $F_c$ required to complete a turn is determined by the following formula: $F_c=mv^2/r$ where m is the mass of the vehicle making the turn, v is the speed of the car, and r is the radius of the turn. Thus when radius of a turn is minimized, the centripetal force required to make that turn for a particular car at a given speed is maximized. In order to make such a turn on conventional banked tracks vehicles have to slow down so much that the total lap time of the shortest patch around the track is longer than the lap time of the current ideal path.

Conventionally race car drivers try to reduce the centripetal force required to make a turn in order to successfully negotiate the turn and avoid a crash. Centripetal force required to make a turn can be reduced by slowing down. Centripetal force can also be reduced be done by increasing the radius of the turn being made because centripetal force is inversely proportional to the radius of the turn being made.

Shorter paths are available around the turn, but the reduction in radius, and therefore path length, causes an increase in the amount of centripetal force required to make the turn. Because the amount of centripetal force from the available sources, i.e., friction, downforce, and side force, is fixed; the velocity must be reduced until required centripetal force is equal to, or less than the available centripetal force.

The invention is applicable to any type of track where vehicles where the amount of surface area available to a vehicle determines how much grab, or friction, will be applied to provided centripetal force to navigate a turn. While the present invention has been illustrated and described with reference to preferred embodiments thereof, it will be apparent to those skilled in the art that modifications can be made and the Invention can be practiced in other environments without departing from the spirit and scope of the invention, set forth in the accompanying claims.

Having described the invention, the following is claimed:

1. A race track configured to encourage passing, the race track comprising:

a pavement that defines a turn;

a first path around the turn;

a second path around the turn that is longer than the first path;

the first path and the second path spaced-apart such that a first car can travel on the first path and a second car can travel on the second path in an overlapped position relative to the first car;

at least a portion of the first path passing over a plurality of depressions defined in the pavement at predetermined positions; and the depressions configured to reduce the amount of friction available to the first car such that the first car is slowed sufficiently for the second car to maintain the overlap position or pass the first car through the turn as the second car travels on the longer second path.

2. A race track according to claim 1, wherein depressions are in the form of grooves.

3. A race track according to claim 2, wherein the grooves extend radially from an inside of the turn to an outside of the turn.

4. A race track according to claim 2, wherein the grooves are evenly spaced-apart around the turn.

5. A race track according to claim 2, wherein the grooves are positioned to define a crosshatched pattern.

6. A race track according to claim 1, wherein the depressions are in the form of pits.

7. A race track according to claim 1, wherein the depressions are positioned such that they are contacted only by tires on one side of the first car.

8. A race track configured to define at least two lanes, the track comprising:

a pavement that has a bearing surface configured to support a vehicle;

the pavement configured to define a first lane on the bearing surface along at least a portion of the circumference of the track;

the pavement of the first lane defines depressions formed therein that extend away from the surface into the pavement;

the pavement configured to define a second lane on the bearing surface along at least a portion of the circumference of the track; and wherein there are more depressions in the first lane per unit surface area of pavement than in the second lane.

9. A race track according the claim 8, wherein the track includes a turn and the first lane and the second lane are defined within the turn.

10. A race track according to claim 9, wherein the track includes an inside and an outside.

11. A race track according to claim 10, wherein the first lane and the second lane begin at a first imaginary line that extends from the infield to the outside edge of the track and first lane and the second lane end at a second imaginary line that extends from the infield to the outside edge of the track such that the second lane is longer than the first lane.

12. A race track according to claim 8, wherein the depressions are in the form of grooves.

13. A turn in a race track configured such that passing within the turn is encouraged, the turn comprising:

a beginning of the turn;

an ending of the turn;

a pavement;

a first path that passes through the turn from the beginning of the turn to the end of the turn and the first path has a first length;

a second path that passes through the turn from the beginning of the turn to the end of the turn and the second path has a second length wherein the second length is longer than the first length;

the pavement having a surface configured to contact tires of vehicles in the turn;

the surface being configured to have a first degree of uniformity positioned to define the first path and a second degree of uniformity positioned to define the second path such that the second degree of uniformity is different than the first degree of uniformity and uniformity is determined by the amount of depressions present in the pavement.

14. The turn in a race track according to claim 13, wherein the first path has a predetermined first working area the surface being configured such that the first working area in the first path is less than a second working area in the second path.

15. The turn in a race track according to claim 14, wherein the first degree of uniformity is not evenly distributed across the first path.

16. The turn in a race track according to claim 13, wherein the pavement of the first path defines depressions formed therein that extend away from the surface into the pavement.

17. A race track according to claim 16, wherein depressions are in the form of grooves.

18. A race track according to claim 17, wherein the grooves extend radially from an inside of the turn to an outside of the turn.

19. A race track according to claim 17, wherein the depressions are in the form of pits.

* * * * *